US006997732B1

(12) United States Patent
Lytle, Jr. et al.

(10) Patent No.: US 6,997,732 B1
(45) Date of Patent: Feb. 14, 2006

(54) SERVICEABLE AUXILIARY MOUNT

(75) Inventors: Joseph Donald Lytle, Jr., Youngstown, OH (US); Donald John Mizner, Sharpsville, PA (US)

(73) Assignee: Delphi Technologies, Inc., Troy, MI (US)

( * ) Notice: Subject to any disclaimer, the term of this patent is extended or adjusted under 35 U.S.C. 154(b) by 535 days.

(21) Appl. No.: 09/675,038

(22) Filed: Sep. 28, 2000

(51) Int. Cl.
*H01R 4/50* (2006.01)

(52) U.S. Cl. ..... 439/347; 439/157

(58) Field of Classification Search ..... 439/153, 439/157, 345, 347, 374, 376
See application file for complete search history.

(56) References Cited

U.S. PATENT DOCUMENTS 5,507,077 A 4/1996 Kotajima
5,596,908 A 1/1997 Hall
5,928,011 A * 7/1999 Flask et al. ..... 439/157
6,254,407 B1 * 7/2001 Burns ..... 439/157
6,270,371 B1 * 8/2001 Doushita ..... 439/376

* cited by examiner

*Primary Examiner*—Khiem Nguyen
(74) *Attorney, Agent, or Firm*—David P. Wood

(57) ABSTRACT

A connector assembly has a slide mechanism for releasably securing and locking together a first connector body and a second connector body. To initially connect together the first and second connector bodies, mounting tabs and lock tabs of the second connector body are disposed in corresponding mounting slots and lock tab slots, respectively, in the first connector body. To releasably lock the connector bodies together, an arm of the slide mechanism is disposed in a channel of the first connector body with a portion of the arm overlying the lock tabs of the second connector body to prevent withdrawal of the lock tabs from the lock tab slots. Thus, removal of the second connector body from the first connector body is prevented while the slide mechanism overlies the lock tabs. Preferably, the slide mechanism and first connector body are adapted to receive a third connector body so that the second and third connector bodies are both releasably attachable to the first connector body by inserting and withdrawing the slide mechanism.

18 Claims, 5 Drawing Sheets

SERVICEABLE AUXILIARY MOUNT

TECHNICAL FIELD

The invention relates generally to connector assemblies and more specifically to a connector assembly with a transverse slide mechanism to prevent separation of a first connector body from a second connector body.

BACKGROUND OF THE INVENTION

A connector assembly commonly has a first connector body attached to a second connector body. U.S. Pat. No. 5,507,077 discloses a connector body connected to a bracket through the use of mating rails, a retainer projection on the bracket having a shoulder and a connector lock projection on the connector body also having a shoulder. During assembly, the connector body and the bracket are slidably engaged until the shoulder of the connector lock projection overlaps a portion of the shoulder of the retainer projection. This disposes the shoulder of the connector lock projection in a position to engage the shoulder of the retainer projection should a force be applied tending to separate them. With the shoulders engaging each other, the connector body is prevented from moving in a direction opposite to the direction of its assembly to the bracket to retain the connector body on the bracket.

U.S. Pat. No. 5,596,908 discloses an arrangement for attaching a remote control assembly to a bulkhead. The remote control assembly has a gripping projection on a flexible arm adapted to be received in a hole in the bulkhead during assembly. Thereafter, a U-shaped lock member is slidably disposed behind the gripping member to prevent flexing of its arm and to maintain the gripping member in the hole of the bulkhead.

SUMMARY OF THE INVENTION

A connector assembly has a slide mechanism for releasably securing and locking together a first connector body and a second connector body. To initially connect together the first and second connector bodies, mounting tabs and lock tabs of the second connector body are disposed in corresponding mounting slots and lock tab slots, respectively, in the first connector body. To releasably lock the connector bodies together, an arm of the slide mechanism is disposed in a channel of the first connector body with a portion of the arm overlying the lock tabs of the second connector body to prevent withdrawal of the lock tabs from the lock tab slots. Thus, removal of the second connector body from the first connector body is prevented while the slide mechanism overlies the lock tabs.

Preferably, the first connector body also has a connector slot for receiving a third connector body and the slide mechanism also secures and releasably locks the third connector body to the first connector body. To accomplish this, the slide mechanism is moved to a preliminary lock position and bayonets extending outwardly from the third connector body are disposed in aligned receiving slots and bayonet slots in the first connector body and slide mechanism, respectively. The bayonet slots in the slide mechanism are inclined relative to the direction of insertion of the slide mechanism into the first connector body. Upon further insertion of the slide mechanism beyond the preliminary lock position, the bayonets are increasingly engaged by the slide mechanism to draw the third connector body firmly down into the connector slot of the first connector body. This further insertion of the slide mechanism also disposes a portion of the slide mechanism over each bayonet to prevent withdrawal of the third connector body from the first connector body.

Accordingly, one object of the present invention is to provide a slide mechanism which releasably locks a first connector body and a second connector body together.

An advantage of the invention is that the same movement of the slide mechanism used to lock the first and second connector bodies together can be used to ensure a good connection of a third connector body to the first connector body and to releasably lock the first and third connector bodies together.

Yet another advantage of the invention is that the connector assembly is easy to both assemble and disassemble such that the time, effort and cost to assemble, disassemble and service are reduced.

BRIEF DESCRIPTION OF THE DRAWINGS

The invention will now be described, by way of example, with reference to the accompanying drawings in which.

DESCRIPTION OF THE PREFERRED EMBODIMENT

Figure 1:
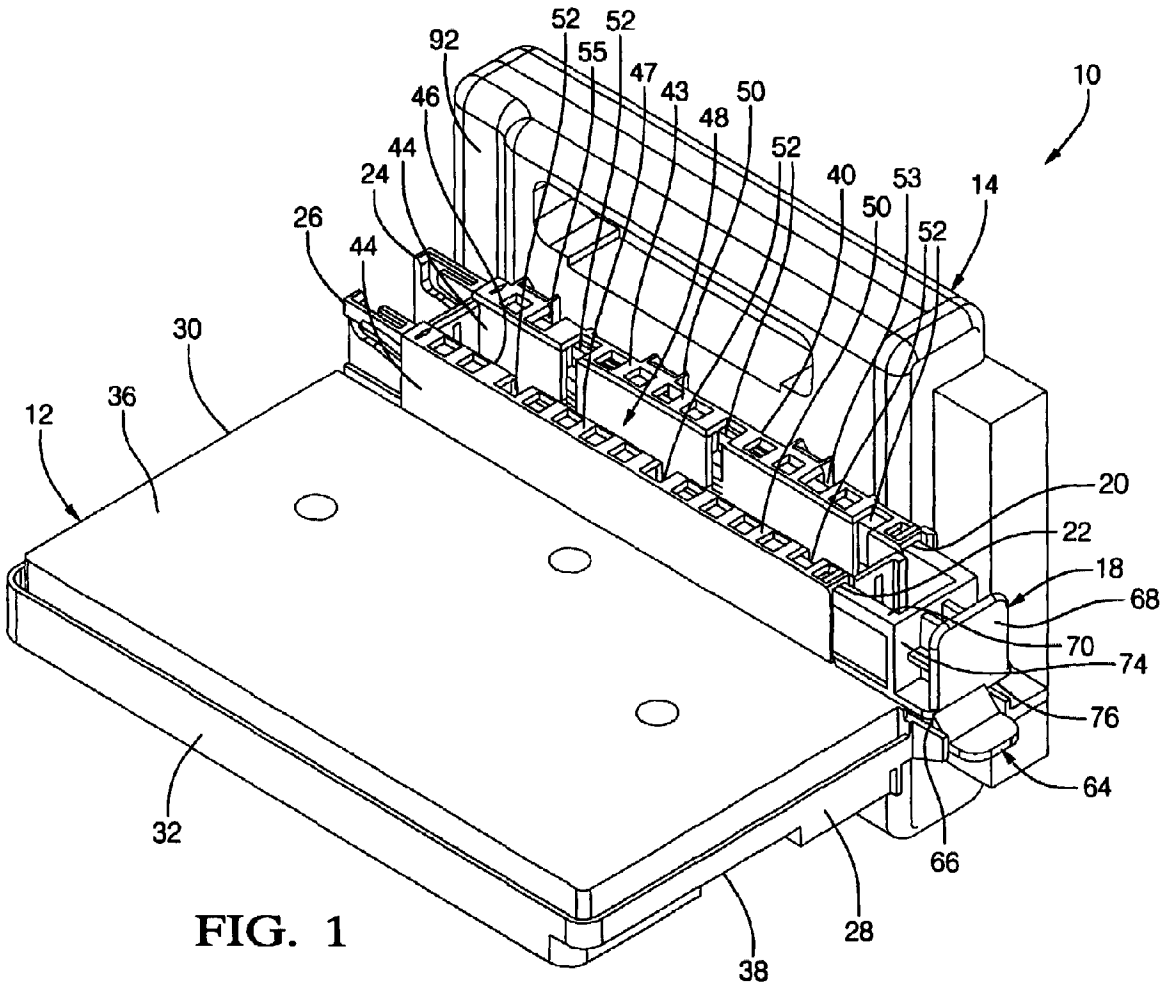
FIG. 1 is a perspective view of a connector assembly embodying the present invention with a slide mechanism in its final lock position releasably locking second and third connector bodies to a first connector body.
Figure 4:
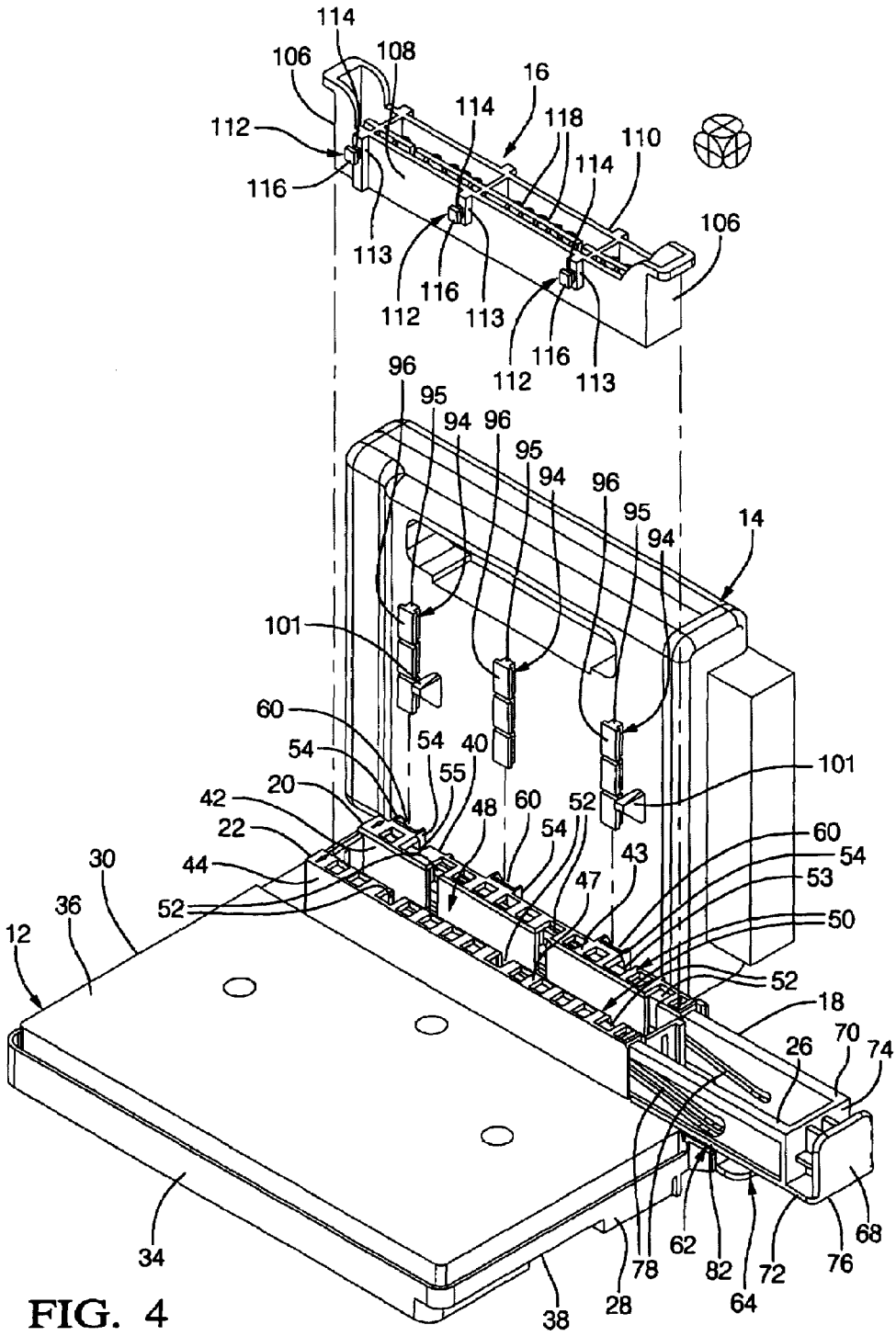
FIG. 4 is a perspective view of the connector assembly illustrating the slide mechanism in a preliminary lock position with the second connector body partially connected to the first connector body and the optional third connector body exploded from the first connector body.
Figure 5:
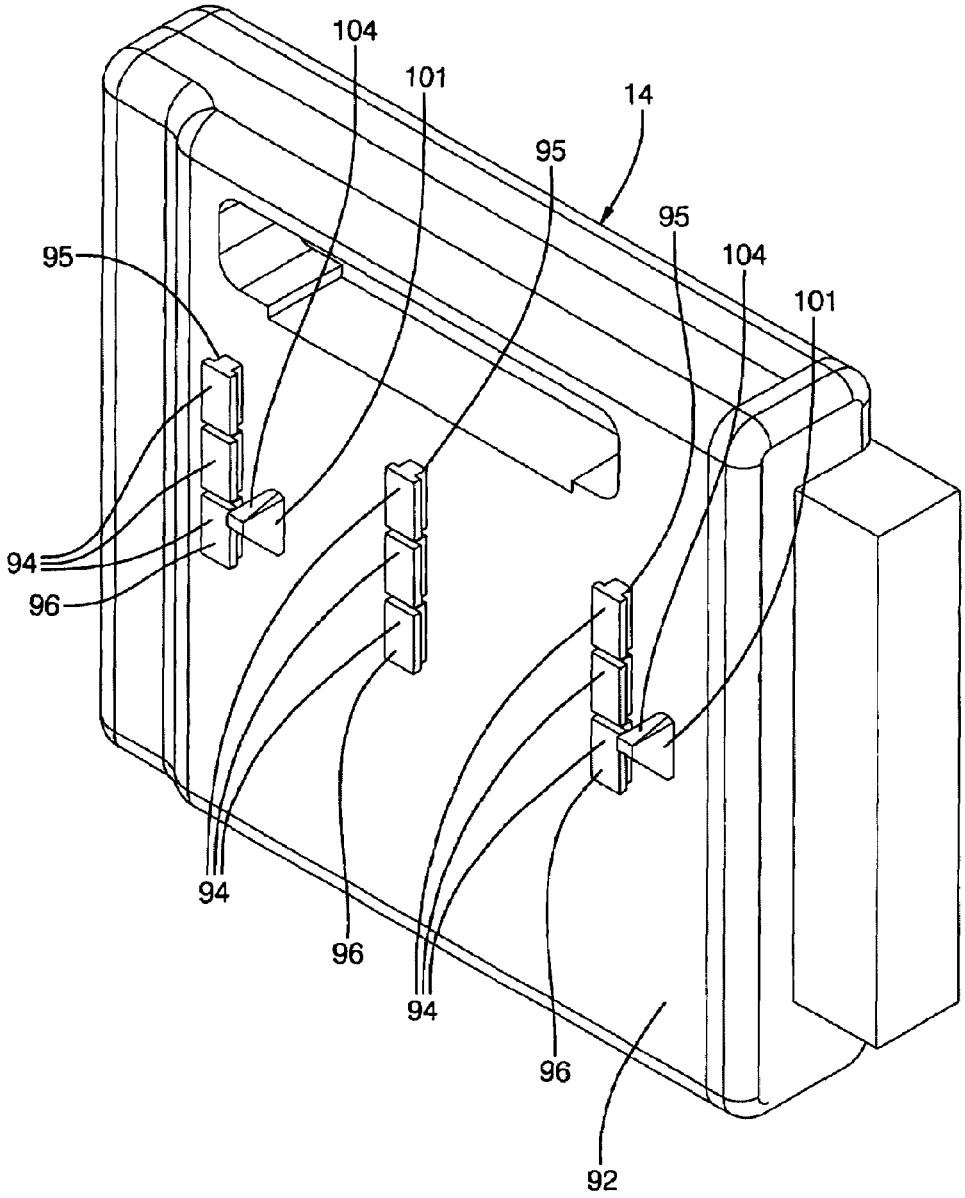
FIG. 5 is a perspective view of the second connector body of the connector assembly.

Referring in more detail to the drawings, FIG. 1 illustrates a connector assembly 10 which has a first connector body 12 and second and third connector bodies 14, 16, respectively, releasably attached and locked to the first connector body 12 by a slide mechanism 18. The first connector body 12 has a first channel 20 and a second channel 22 each adapted to releasably receive one of a first arm 24 and a second arm 26 of the slide mechanism 18. To initially interconnect the connector bodies, the arms 24, 26 of the slide mechanism 18 are slidably positioned in the channels 20, 22 of the first connector body 12 until they reach a preliminary lock position, as best shown in FIG. 4, wherein the second connector body 14 and third connector body 16 may be attached to the first connector body 12. To lock the second and third connector bodies 14, 16 to the first connector body 12, the arms 24, 26 of the slide mechanism 18 are further slidably inserted into the channels 20, 22 of the first connector body 12 until the slide mechanism 18 reaches a final lock position, as best shown in FIG. 1, where separation of the second and third connector bodies 14, 16 from the first connector body 12 is prevented. The slide mechanism 18 can thereafter be moved from the final lock position back to the preliminary lock position if it is desired to separate the second and third connector bodies 14, 16 from the first connector body 12.

Figure 2:
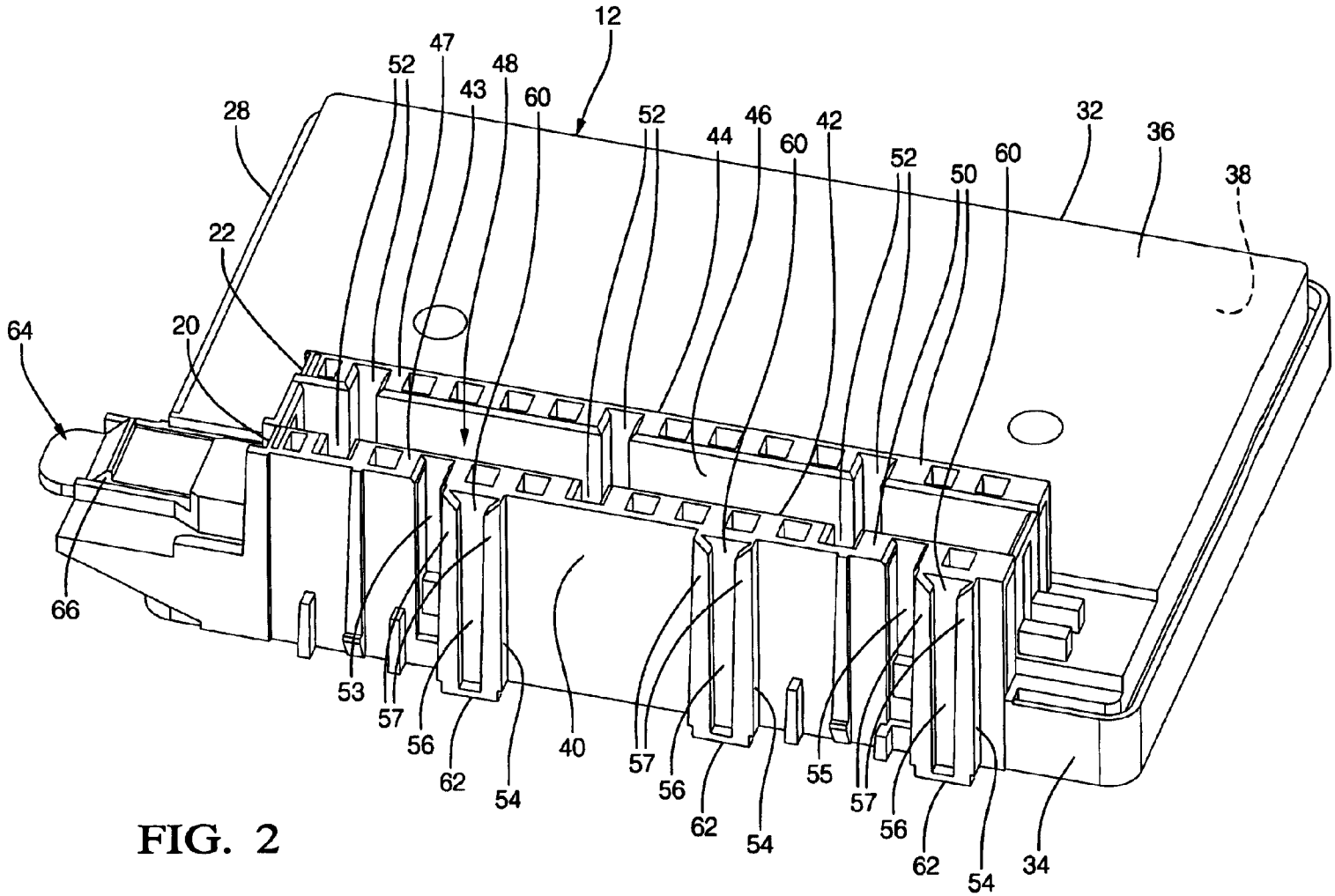
FIG. 2 is a perspective view of the first connector body of the connector assembly.

As best shown in FIG. 2, the first connector body 12 has opposed first and second end walls 28, 30 and opposed front and rear walls 32, 34 extending between the end walls 28, 30 and top and bottom faces 36, 38. Preferably, a first external wall 40 of the first channel 20 defines in part the rear wall 34 and extends upwardly beyond the top face 36. A first internal wall 42 of the first channel 20 extends generally parallel to the first external wall 40 and upwardly from the top face to the same extent as wall 40. The walls 40, 42 are joined along their upper edges by various tabs 43 integral with the walls 40, 42 to effectively enclose the channel 20. Similarly, the second channel 22 has a second external wall 44 and a second internal wall 46 joined by integral tabs 47 to the external wall 44 to effectively enclose the second channel 22. The second channel 22 is spaced apart from and generally parallel to the first channel 20 such that a connector slot 48 is formed between the first and second channels 20, 22. The first and second internal walls 42, 46 of the first and second channels 20, 22, respectively, have an upper surface 50 defined by their respective tabs 43, 47 and at least two spaced apart receiving slots 52, preferably opposing each other such that they mirror each other, which are open through the upper surface 50. The first external wall 40 of the first channel 20 has at least one lock tab slot, and preferably first and second lock tab slots 53, 55 extending downwardly from the upper surface 50 and generally transversely to the channel 20. The first external wall 40 also has outwardly extending elongate projections 54 with opposed inwardly extending flanges 57 defining mounting slots 56 which are open at their upper ends 60 and closed at their lower ends 62. Preferably, a lock arm 64 having a catch 66 extending upwardly therefrom extends beyond the first end wall 28 aligned at least in part with the second channel 22 so that the catch 66 of the lock arm 64 is engaged by the second arm 26 when the slide mechanism 18 is inserted into the first connector body 12.

Figure 3:
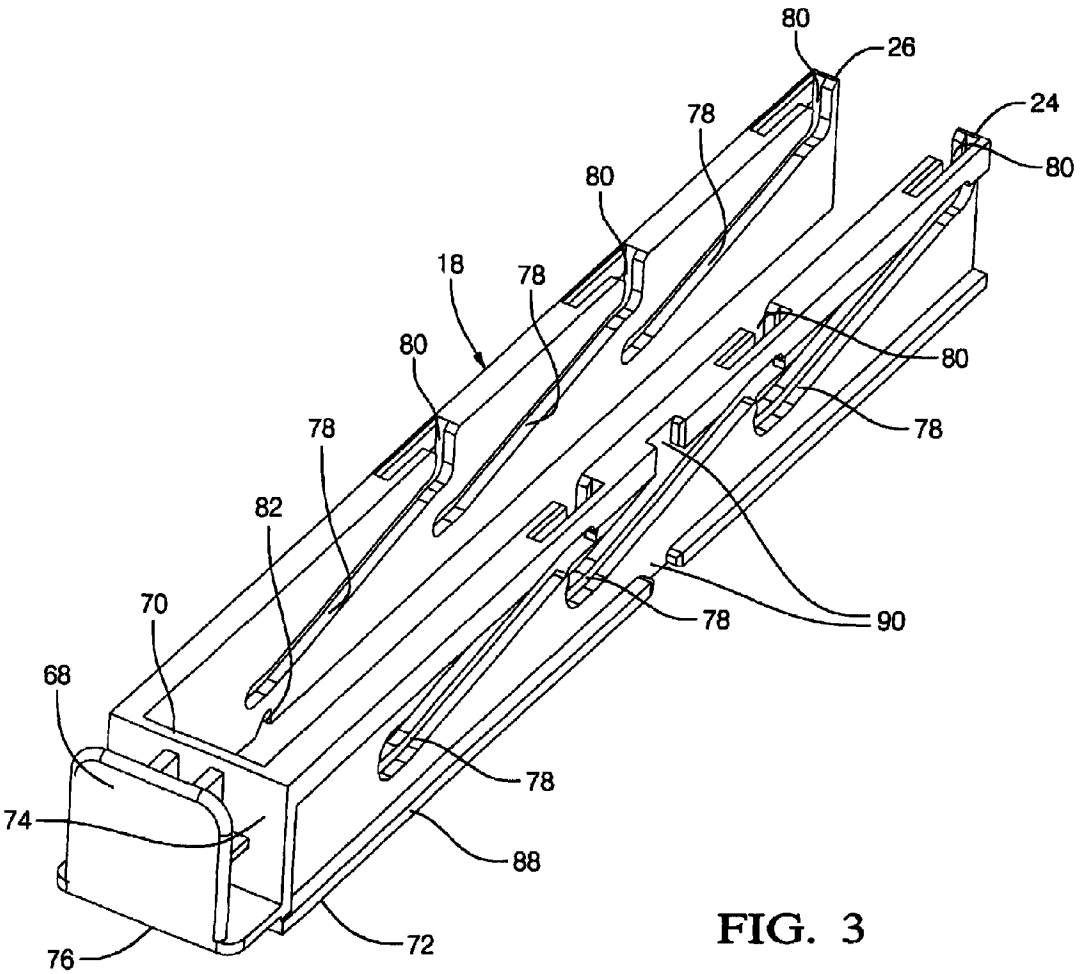
FIG. 3 is a perspective view of the slide mechanism of the connector assembly.

As best shown in FIG. 3, the first and second arms 24, 26 of the slide mechanism 18 are constructed to be received in the first and second channels 20, 22 and are interconnected by an end wall 74 to which a push plate 68 is attached. The push plate 68 is preferably integrally formed with the arms 24, 26. As best shown in FIGS. 1 and 3, the push plate 68 has a shoulder 76 engageable by the catch 66 on the lock arm 64 to prevent the slide mechanism 18 from inadvertently moving from its final lock position. The first and second arms 24, 26 preferably both have bayonet slots 78 which are inclined relative to the direction of slidable movement of the slide mechanism 18 into the first connector body 12. The bayonet slots 78 have bayonet openings 80 which extend through an upper surface 70 of the arms 24, 26. To locate the slide mechanism 18 in its preliminary lock position, at least one of the arms 24, 26 (the second arm 26 as shown) has a notch 82 for releasable engagement with the catch 66 on the lock arm 64. The first arm 24 of the slide mechanism 18 has an elongate lock rail 88 extending generally outwardly from a lower surface 72 of the first arm 24 and a lock tab groove 90, which as shown, may be in both the lock rail 88 and the upper surface 70 of the first arm 24. When the slide mechanism 18 is in the preliminary lock position, as best shown in FIG. 4, the bayonet openings 80 in the slide mechanism 18 are aligned with the receiving slots 52 in the first and second channels 20, 22, and the lock tab groove 90 on the slide mechanism 18 is aligned with the first lock tab slot 53 in the first channel 20. The slide mechanism 18 stops short of the second lock tab slot 55 when it is in the preliminary lock position.

The second connector body 14 can be any surface or body having a mounting surface 92 with T-shaped mounting tabs 94 thereon, including by way of example and without limitation, an electrical connector or a wall. For connection to the first connector body 12, the T-shaped mounting tabs 94 have a stem 95 extending outwardly from the second connector body 14 and a flat head 96 connected to and extending generally transversely to the stem 95. There is at least one mounting tab 94 for each mounting slot 56 and preferably a row of mounting tabs 94 for each slot 56 as shown. The mounting tabs 94 are positioned on the planar mounting surface 92 and are constructed and arranged to be slidably received in the mounting slots 56 on the first connector body 12. The heads 96 of the mounting tabs 94 are initially received in the open upper ends 60 of the mounting slots 56 and are slidably disposed in the mounting slots 56 until a lowermost tab 94 associated with each slot 56 engages the closed lower end 62 of the mounting slot 56. The heads 96 of the mounting tabs 94 are retained in the mounting slots 56 by the inwardly extending flanges 57 so that the mounting tabs 94 are prevented from being removed from the mounting slots 56 in all directions except that of their insertion into the slots 56. Thus, the second connector body 14 is prevented from separating from the first connector body 12 in all but the direction of its assembly onto the first connector body 12.

The second connector body 14 also has at least one lock tab, more preferably at least first and second lock tabs 100, 101 each with a planar surface defining a shoulder 104 extending outwardly and generally perpendicularly from the mounting surface 92. Each lock tab 100, 101 is constructed and arranged so that the lock rail 88 cooperates with the lock tabs 100, 101 and the lock tabs 100, 101 extend into one of the lock tab slots 53, 55 in the first channel 20 of the first connector body 12.

According to the preferred embodiment of the invention, a third connector body 16 may also be connected to the first connector body 12. The third connector body 16 is constructed and arranged to be releasably received in the connector slot 48 in the first connector body 12. As best shown in FIG. 6, the third connector body 16 has opposed end walls 106 and opposed front and rear walls 108, 110 extending between the end walls 106. The front and rear walls 108, 110 have bayonets 112 with a base 113, a generally cylindrical portion 114 extending outwardly and generally orthogonally from the base 113, and an enlarged, flat head 116 extending from the cylindrical portion 114 and generally parallel to the walls 108, 110. In assembly, the bayonets 112 are releasably received in the receiving slots 52 of the first connector body 12 and in the bayonet openings 80 of the slide mechanism 18.

In the preferred embodiment, the third connector body 16 is an electrical connector which has a plurality of terminal cavities 118 which each contain an electrical terminal (not shown). Correspondingly, the first connector body 12 has a plurality of mating electrical terminals (not shown) within its connector slot 48. The terminals of the third connector body 16 and first connector body 12 are electrically connected upon full insertion of the third connector body 16 into the connector slot 48 to complete at least a portion of an electrical circuit.

To assemble the second and third connector bodies 14, 16 to the first connector body 12, the first and second arms 24, 26 on the slide mechanism 18 are placed into the first and second channels 20, 22 on the first connector body 12 and slidably inserted to the preliminary lock position defined by the engagement of the catch 66 on the lock arm 64 with the notch 82 in the slide mechanism 18. In more detail, as the first and second arms 24, 26 are being inserted, the lock arm 64 on the first connector body 12 is flexed downwardly by the engagement of the lower surface 72 of the second arm 26 with the catch 66 on the lock arm 64 until the notch 82 reaches the catch 66 where upon the resilient lock arm 64 returns towards its unflexed position to allow the catch 66 to releasably engage and seat in the notch 82. While in the preliminary lock position, the second connector body 14 can be attached to the first connector body 12 by slidably inserting the mounting tabs 94 on the second connector body 14 into the mounting slots 56 on the first connector body 12. The inwardly extending flanges 57 of the slots 56 trap the heads 96 of the T-shaped mounting tabs 94 to retain the tabs 94 and permit only slideable movement of the tabs 94 in the slots 56. The lock tabs 100, 101 on the second connector body 14 are simultaneously slidably received through the aligned lock tab slots 53, 55 in the first connector body 12 and the lock tab groove 90 in the slide mechanism 18. Additionally, the third connector body 16 can be attached to the first connector body 12 by inserting it into the connector slot 48 with its bayonets 112 disposed in the aligned bayonet openings 80 in the slide mechanism 18 and receiving slots 52 in the first connector body 12. In this embodiment, the second connector body 14 can be attached to the first connector body 12 to the extent described without the slide mechanism 18 received in any part in the channels 20, 22. However, the third connector body 16 requires the slide mechanism 18 to be in its preliminary lock position so that the bayonets 112 can be received into the bayonet openings 80 as well as the receiving slots 52.

After the second and third connector bodies 14, 16 are initially attached to the first connector body 12 as described, the slide mechanism 18 can be further slidably inserted into the first and second channels 20, 22. As the slide mechanism 18 is advanced, the lock arm 64 is flexed downwardly so that the catch 66 comes out of the notch 82 and slides along the lower surface 72 of the slide mechanism 18. As shown in FIG. 1, after the shoulder 76 on the slide mechanism 18 passes the catch 66 on the lock arm 64, the lock arm 64 returns to its unflexed position overlying a portion of the shoulder 76 to releasably lock the slide mechanism 18 in the final lock position. In the final lock position, the lock rail 88 on the first arm 24 is positioned over the lock tabs 100, 101 on the second connector body 14 and the lock rail 88 extends generally transversely to the direction of the lock tab slots 53, 55 in the first connector body 12. Thus, if the second connector body 14 is moved in a direction tending to remove it from the first connector body 12, the lock tabs 100, 101 engage the rail 88 to prevent separation of the second connector body 14 from the first connector body 12.

Also, as the slide mechanism 18 is being moved from its preliminary lock position towards the final lock position, the third connector body 16 is drawn further into the connector slot 48 of the first connector body 12 by the increasing engagement of the slide mechanism 18 with the bayonets 112 in the inclined bayonet slots 78 in the slide mechanism 18. The bayonet slots 78 are contoured and inclined so that the slide mechanism 18 engages and acts as a cam on the bayonets 112 of the third connector body 16 to displace them within the receiving slots 52 in the first connector body 12. This greatly improves the connection between the third and first connector bodies 16, 12. Desirably, the sliding movement of the slide mechanism 18 relative to the first connector body 12 also moves the bayonet openings 80 out of alignment with the receiving slots 52 to close the slots 52 and prevent withdrawal of the bayonets 112 from the slots 52 and thus, the third connector body 16 from the first connector body 12. Therefore, when the slide mechanism 18 is in the final lock position, the second connector body 14 and the third connector body 16 are releasably locked to the first connector body 12 to prevent their inadvertent separation.

The first, second, and third connector bodies 12, 14, 16 can be separated from each other by depressing the lock arm 64 on the first connector body 12 so that the shoulder 76 can clear the catch 66 on the lock arm 64, and then pulling and slidably displacing the slide mechanism 18 outwardly until the slide mechanism 18 reaches the preliminary lock position. When the slide mechanism 18 is in the preliminary lock position, the second and third connector bodies 14, 16 can be separated from the first connector body 12 in the reverse manner in which they were originally attached to the first connector body 12. This facilitates, for example, servicing and repairing any of the connector bodies.

Accordingly, the present invention facilitates assembly of one or more connector bodies to a first connector body 12. Notably, in the embodiment described above, either the second or third connector body 14, 16 can be separately attached to the first connector body 12 without the other, thus increasing the flexibility of the connector assembly. It also facilitates removing the connector bodies for ease of repair or to provide for attachment of a new connector body. Further, a single slide mechanism 18 preferably mechanically locks each connector body to the first connector body 12. The slide mechanism 18 may also be used to improve or assure a connection of at least one other connector body to the first connector body 12.

The invention claimed is:

1. A connector assembly comprising:

a slide mechanism having an arm with a lock rail and a bayonet slot in the arm;

a first connector body having a mounting slot and a channel for releasably receiving the arm of the slide mechanism;

a second connector body having a mounting tab constructed to be releasably received in the mounting slot of the first connector body to connect the first connector body and second connector body together, and a lock tab which in assembly cooperates with the lock rail and engages the lock rail to prevent separation of the second connector body and first connector body; and a third connector body having a bayonet constructed to be received in the bayonet slot of the slide mechanism so that the third connector body is releasably connected to the first connector body when the arm of the slide mechanism is disposed in the channel of the first connector body.

2. The connector assembly of claim 1 which also comprises a second channel in the first connector body and a second arm of the slide mechanism constructed to be releasably received in the second channel.

3. The connector assembly of claim 2 wherein the second channel is spaced from and generally parallel to the other channel of the first connector body to define in part a connector slot in which the third connector body is received.

4. The connector assembly of claim 3 wherein each arm has at least one bayonet slot and the third connector body has a pair of opposed walls and a bayonet for each bayonet slot so that the third connector is retained on both walls by the slide mechanism.

5. The connector assembly of claim 1 wherein the bayonet slot is inclined to provide a camming surface slidably engageable with the bayonet to cause a corresponding movement of the third connector body relative to the first connector body when the arm of the slide mechanism is slidably moved in the channel.

6. The connector assembly of claim 1 which also comprises a receiving slot in the first connector body for releasably receiving the bayonet on the third connector body.

7. The connector assembly of claim 6 which also comprises an opening into the bayonet slot wherein the arm of the slide mechanism is slidably movable in the channel to a preliminary position wherein the receiving slot and the opening of the bayonet slot are aligned to receive the bayonet and a final lock position wherein the opening of the bayonet slot is not aligned with the receiving slot.

8. The connector assembly of claim 7 which also comprises a notch and a shoulder on the slide mechanism and a lock arm on the first connector body having a catch engageable with the notch to locate the slide mechanism in its preliminary position, and constructed to engage the shoulder to releasably maintain the slide mechanism in its final lock position.

9. The connector assembly of claim 8 which also comprises a lock tab slot in the first connector body for receiving the lock tab on the second connector body such that when the slide mechanism is in its final lock position the lock rail overlies the lock tab to prevent separation of the first connector body and the second connector body.

10. The connector assembly of claim 9 which also comprises a second lock tab on the second connector body and a second lock tab slot in the first connector body for receiving the second lock tab such that when the slide mechanism is in its final lock position, the lock rail overlies both lock tabs to prevent separation of the first connector body and the second connector body.

11. A connector assembly comprising:

a slide mechanism having an arm with a lock rail and a bayonet slot in the arm;

a first connector body having a mounting slot and a channel for releasably receiving the arm of the slide mechanism;

a second connector body having a mounting tab constructed to be releasably received in the mounting slot of the first connector body to connect the first connector body and second connector body together, and a lock tab which in assembly cooperates with the lock rail and engages the lock rail to prevent separation of the second connector body and first connector body;

a third connector body having a bayonet constructed to be received in the bayonet slot of the slide mechanism so that the third connector body is releasably connected to the first connector body when the arm of the slide mechanism is disposed in the channel of the first connector body;

a receiving slot in the first connector body for releasably receiving the bayonet on the third connector body;

an opening into the bayonet slot wherein the arm of the slide mechanism is slidably movable in the channel to a preliminary position wherein the receiving slot and the opening of the bayonet slot are aligned to receive the bayonet and a final position wherein the opening of the bayonet slot is not aligned with the receiving slot;

a notch and a shoulder on the slide mechanism and a lock arm on the first connector body having a catch engageable with the notch to locate the slide mechanism in its preliminary position, and constructed to engage the shoulder to releasably maintain the slide mechanism in its final lock position;

a lock tab slot in the first connector body for receiving the lock tab on the second connector body such that when the slide mechanism is in its final lock position the lock rail overlies the lock tab to prevent separation of the first connector body and the second connector body; and wherein the channel extends generally transversely to the lock tab slot so that when the arm is received in the channel, the lock rail on the slide mechanism extends generally transversely to the direction of the lock tab slot in the first connector body such that when the lock tab is fully received in the lock tab slot, movement of the second connector body in a direction tending to remove the lock tab from the lock tab slot causes the lock tab to engage the lock rail to prevent separation of the second connector body from the first connector body.

12. The connector assembly of claim 1 which also comprises a second lock tab on the second connector body and, in assembly, the lock rail overlies both lock tabs to prevent separation of the first connector body and the second connector body.

13. A connector assembly comprising:

a first connector body having a channel and a mounting slot extending outwardly from an external wall of the first connector body;

a second connector body having a lock tab and a mounting tab said mounting tab constructed to be releasably received in the mounting slot of the first connector body to connect the first connector body and second connector body together; and a slide mechanism having a preliminary lock position and a final lock position having an arm with a bayonet slot for receiving a third connector body constructed to be slidably, releasably received in the channel and a lock rail separate from the bayonet slot and extending outwardly from the arm which engages the lock tab to prevent separation of the second connector body and first connector body when the slide mechanism is in the final lock position.

14. The connector assembly of claim 13 which also comprises a second channel in the first connector body and a second arm of the slide mechanism constructed to be releasably received in the second channel.

15. The connector assembly of claim 13 which also comprises a notch on the slide mechanism and a lock arm on the first connector body having a catch engageable with the notch to locate the slide mechanism in a preliminary position, and constructed to releasably maintain the slide mechanism in a final lock position.

16. The connector assembly of claim 15 which also comprises a lock tab slot in the first connector body for receiving the lock tab on the second connector body such that when the slide mechanism is in its final lock position the lock rail overlies the lock tab to prevent separation of the first connector body and the second connector body.

17. The connector assembly of claim 16 which also comprises a second lock tab on the second connector body and a second lock tab slot in the first connector body for receiving the second lock tab such that when the slide mechanism is in its final lock position, the lock rail overlies both lock tabs to prevent separation of the first connector body and the second connector body.

18. A connector assembly comprising:

a first connector body having a channel and a mounting slot;

a second connector body having a lock tab and a mounting tab constructed to be releasably received in the mounting slot of the first connector body to connect the first connector body and second connector body together;

a slide mechanism having an arm constructed to be slideably, releasably received in the channel and a lock rail which in assembly cooperates with the lock tab and engages the lock tab to prevent separation of the second connector body and first connector body;

a notch on the slide mechanism and a lock arm on the first connector body having a catch engageable with the notch to locate the slide mechanism in a preliminary position, and constructed to releasably maintain the slide mechanism in a final lock position;

a lock tab slot in the first connector body for receiving the lock tab on the second connector body such that when the slide mechanism is in its final lock position the lock rail overlies the lock tab to prevent separation of the first connector body and the second connector body; and wherein the channel extends generally transversely to the lock tab slot so that when the arm is received in the channel, the lock rail on the slide mechanism extends generally transversely to the direction of the lock tab slot in the first connector body such that when the lock tab is fully received in the lock tab slot, movement of the second connector body in a direction tending to remove the lock tab from the lock tab slot causes the lock tab to engage the lock rail to prevent separation of the second connector body from the first connector body.

* * * * *